US005561914A

United States Patent [19]

Asplin

[11] Patent Number: 5,561,914

[45] Date of Patent: Oct. 8, 1996

[54] SAND DRYING APPARATUS

[76] Inventor: Charles L. Asplin, 909 25th Ave. North, Fargo, N. Dak. 58102

[21] Appl. No.: 624,836

[22] Filed: Mar. 22, 1996

[51] Int. Cl.[6] ..... F26B 17/12

[52] U.S. Cl. ..... 34/165; 34/92; 34/65; 34/406; 34/361

[58] Field of Search ..... 34/92, 218, 403, 34/406, 361, 579, 165, 65

[56] References Cited

U.S. PATENT DOCUMENTS

| | | | |
|---|---|---|---|
| 2,177,404 | 10/1939 | Golden | 34/34 |
| 3,411,215 | 11/1968 | Fields | 34/12 |
| 4,197,660 | 4/1980 | Breitschaft et al. | 34/166 |
| 4,439,933 | 4/1984 | Dietrich et al. | 34/65 |
| 4,546,821 | 10/1985 | Kiimmel | 165/96 |
| 4,839,969 | 6/1989 | Hahn | 34/169 |

FOREIGN PATENT DOCUMENTS

| | | |
|---|---|---|
| 1638479 | 3/1991 | United Kingdom . |
| 144282 | 6/1991 | United Kingdom . |
| 1698602 | 12/1991 | United Kingdom . |
| 2674944 | 10/1992 | United Kingdom . |

*Primary Examiner*—Henry A. Bennett
*Assistant Examiner*—Dinnatia Doster
*Attorney, Agent, or Firm*—Curtis V. Harr

[57] ABSTRACT

A mobile Sand Dryer is disclosed. This dryer is substantially made up of two portions. The first portion of the Sand Dryer is a wet sand tank. This tank is essentially divided into two distinct portions; an upper wet sand holding chamber and a lower sand drying chamber. The two chambers are divided by a grate. The upper wet sand holding chamber is supplied with a removable lid as well as a fan which may be used to create a vacuum in the chamber. The lower sand drying chamber is supplied with a propane burner and a hopper bottom. During use wet sand is placed in the upper wet sand drying chamber via the removable lid. The wet sand collects on the steel grate as it is placed into the chamber. Upon ignition of the burner and the fan the vacuum crated by the fan tends to draw the heat and moisture from the sand up and out the top of the chamber. As the sand on the grate is dried it falls through the grate before finally be moved via a vacuum tube to the second chamber. The second chamber is essentially used as dry sand storage chamber where dried sand may be kept until such as it is needed.

12 Claims, 3 Drawing Sheets

SAND DRYING APPARATUS

BACKGROUND OF THE INVENTION

This invention relates to driers for use in drying wet granular material and more particularly for providing a means of continuously drying wet granular material, such as sand, in such a manner as to provide the dried granular substance in small to moderate quantities.

The need for driers which can be used to effectively dry wet granular material such as sand has long been known. Dry sand is a frequent requirement in various aspects of the construction industry. One use for dry sand is in the mixing of certain dry premix mortars and cements. A second use for dry sand is the use of sand blasters wherein dry sand is mixed with air at high pressure and used for a variety of situations such as the removal of paint or rust from metals.

Driers which have been commonly used have employed several methods of obtaining a dry, non-clumped product. One of the main problems associated with the drying of any granular material is its tendency to clump or agglomerate. This problem has often been solved by providing driers with a stirring mechanism or by building multi-level type driers. When these type of mechanism have been employed, the driers have been, by necessity, high volume and thus large in size. The large size of these dryers usually requires the dryer to be permanently employed at a given site.

In certain situations it is desirable to have a small mobile continuous drier that does not need to be permanently placed. This mobile ability can often allow for great savings in transportation and hauling costs. It is further desirable to have a drier that its simple and has relatively few or no moving parts with the exception of fans or vacuums.

From the foregoing discussion it can be seen that it would be advantageous to create a continuous sand dryer which has relatively few, if any, moving parts and can easily be moved from one job site to another.

SUMMARY OF THE INVENTION

It is the primary objective of the present invention to provide a method of easily and inexpensively drying the necessary quantities of sand that may be required at various job sites.

Additionally, it is an objective of the present invention to provide a portable and efficient technique for drying sand without the need for a large permanent sand drying plant. It is further an objective to provide a mobile plant which has a minimum of moving parts that may require service or replacement at an additional cost.

The present invention addresses the aforementioned problems and solves them by providing a mobile Sand Drying Apparatus which is further characterized by achieving the above objectives of mobility and efficiency. The present invention is comprised of a wet sand drying tank and a dry sand tank. Wet sand is placed upon a grate and heat is applied to the bottom of the grate via a propane heater, while creating a vacuum above the wet sand. Thus, as the wet sand on the grate becomes dry it falls through the grate and is transported via a vacuum line to the dry sand storage tank.

More specifically, the above objectives are achieved and problems solved by providing a mobile Sand Dryer. This Sand Dryer is comprised of two separate hopper type tanks attached to a support framework. This framework is further supplied with a wheels so that the entire unit may easily be moved from one job site to another.

The first portion of the Sand Dryer is the wet sand tank. This tank is essentially divided into two distinct portions; an upper wet sand holding area and a lower sand drying chamber. The two chambers are divided by a grate. This grate may be made of any suitable spacing, however, one spacing that has been found to work well is a 2"×¼" bar placed at ¼" spacing. The upper wet sand holding area is supplied with a removable lid as well as a fan which may be used to create a vacuum in the chamber. The lower sand drying area is supplied with a propane burner and a hopper bottom. The hopper bottom is further supplied with a vacuum tube which leads to the dry sand storage tank. During use, wet sand is placed in the upper wet sand drying chamber by opening the removable lid. The wet sand collects on the steel grate as it is placed into the chamber. The inability of the sand to flow through the grate is due to the cohesive nature of wet sand. When a suitable amount of sand has been placed in the chamber, the propane burner and fan are started. As the fan creates a vacuum it tends to draw the heat and moisture from the sand up and out the top of the chamber. The wet sand directly on the grate or which is closest to the heat source will dry first and lose its cohesive nature and as it does it will fall through the grate and collect at the bottom of the hopper where the dry sand is carried off via a the vacuum tube to a dry sand storage tank.

The second chamber of the present invention is essentially a dry sand storage hopper chamber. This chamber has an opening at its top which is connected to a vacuum mechanism strong enough to create a vacuum in the chamber. The chamber is further connected to the first tank via a tube leading the bottom of the first chamber. Thus, the vacuum created will move the dry sand from the first chamber to the second storage tank via the tube. This dry sand storage chamber is further supplied with a valve at it lower portion. This valve provides a means of removing the dry sand as needed.

For a better understanding of the present invention reference should be made to the drawings in which there is illustrated and described preferred embodiments of the present invention.

DESCRIPTION OF THE PREFERRED EMBODIMENT

Figure 1:
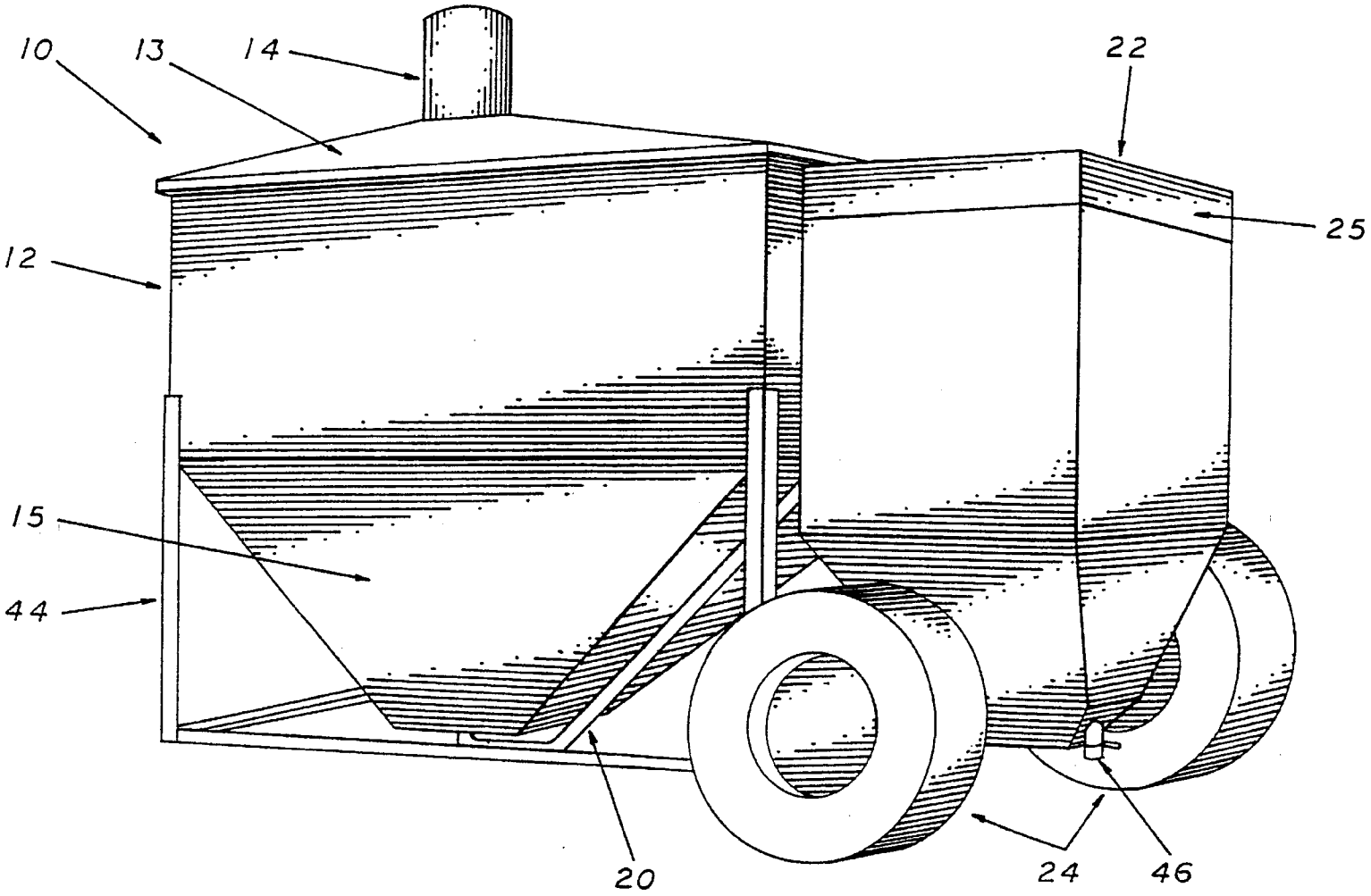
FIG. 1 is a perspective view of the Sand Dryer showing the orientation of the wet sand tank, the dry sand tank, and the sand transfer tube with respect to one another.

Referring now to the drawings, and more specifically to FIG. 1, the multi-chambered Sand Dryer 10 is made up of two separate and distinct tanks or chambers, the wet sand tank 12 and the dry sand tank 22. The wet sand tank 12 has an angled roof 13 which is also hinged; this allows the roof 13 to be swung open for the loading of wet sand into the wet sand tank 12. At the center and top of the roof 13 is the fan cone 14. The lower outside surfaces of the wet sand tank 12 are angled inward to form the lower beveled collection area 15. This whole structure is held in place by the wet sand tank support frame 44 which is attached to the side of the wet sand tank at its upper end and rests on the ground at its lower.

At the lower most surface of the lower beveled collection area 15, dry sand is transported to the dry sand tank 22 by means of the dry sand transfer tube 20 which runs up the outside surface of the wet sand tank 12 and into the dry sand tank 22 at its most upward end.

The dry sand tank 22 may be provided with an optional removable lid 25 which extends completely around the most outward edge of the dry sand tank 22 at its most upward end. The purpose of the optional lid 25 is to allow one to gain access to the inside of the dry sand tank 22 for periodic cleaning. At the lower end of the dry sand tank 22 there are attached the Sand Dryer transport wheels 24, which allow for the transport of the entire system, and the dry sand removal valve 46, which allows for the removal of the dry sand from the dry sand tank 22 either by gravity or by the use of an externally mounted vacuum.

Figure 2:
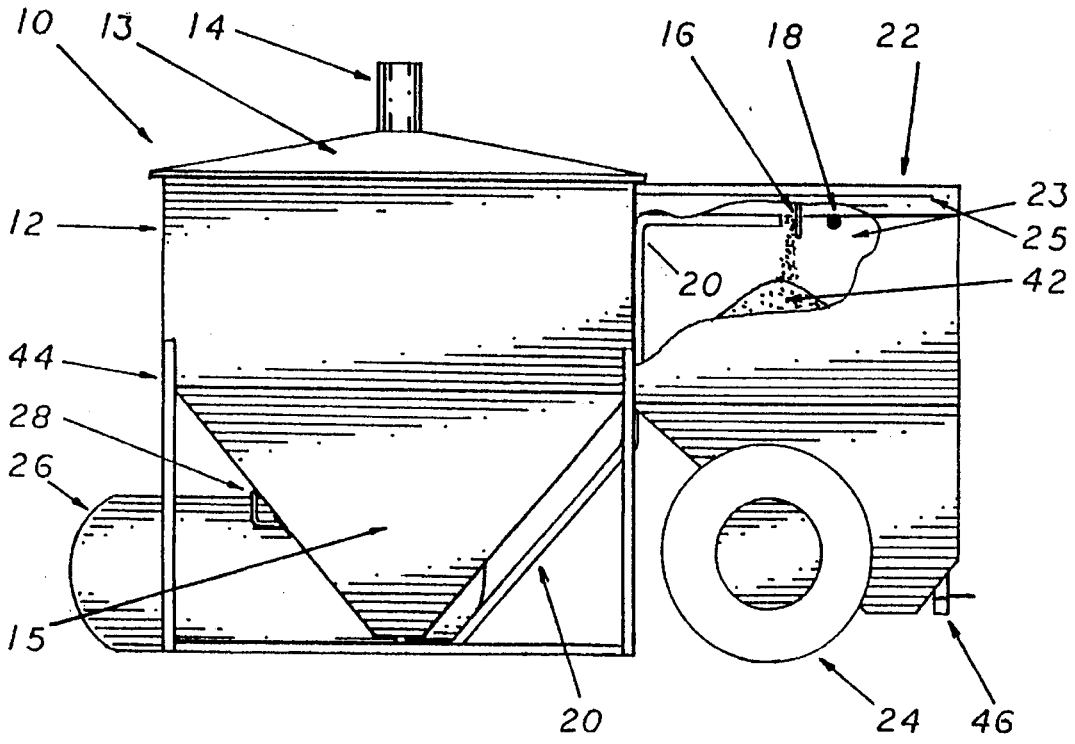
FIG. 2 is a side elevation cut-away view of the present invention showing the orientation of its major components to one another and also the manner in which the dried sand is transferred to the dry sand tank.
Figure 3:
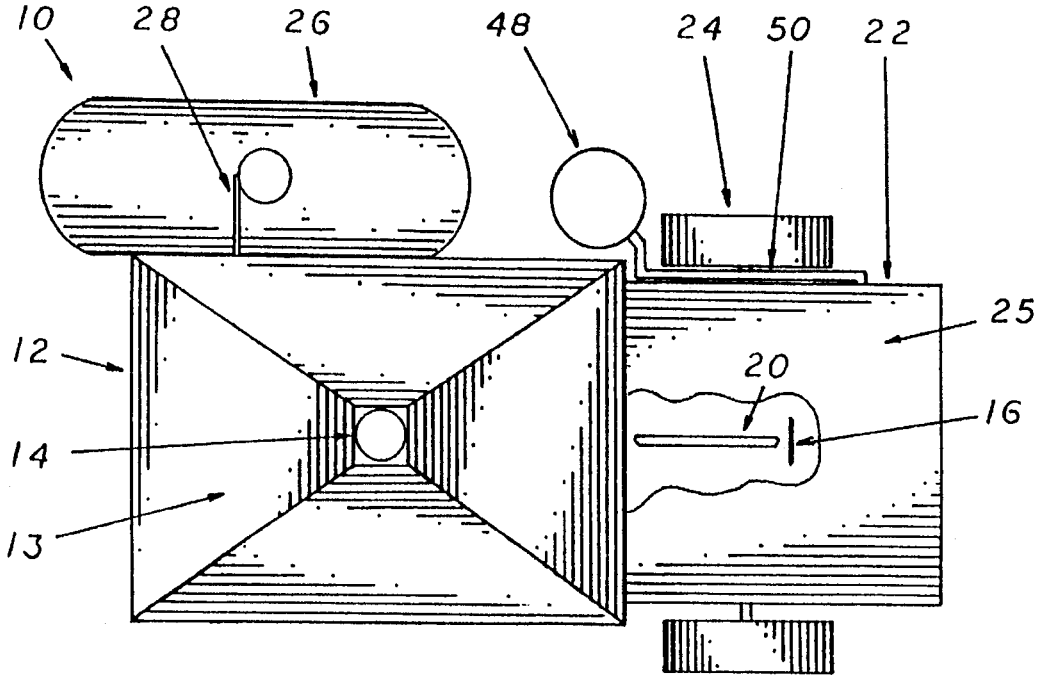
FIG. 3 is a top elevation cut-away view of the present invention showing the orientation of the major components including the propane tank which provides the fuel to dry the sand in the wet sand tank and the vacuum which provides the means for the transfer of the dry sand.
Figure 4:
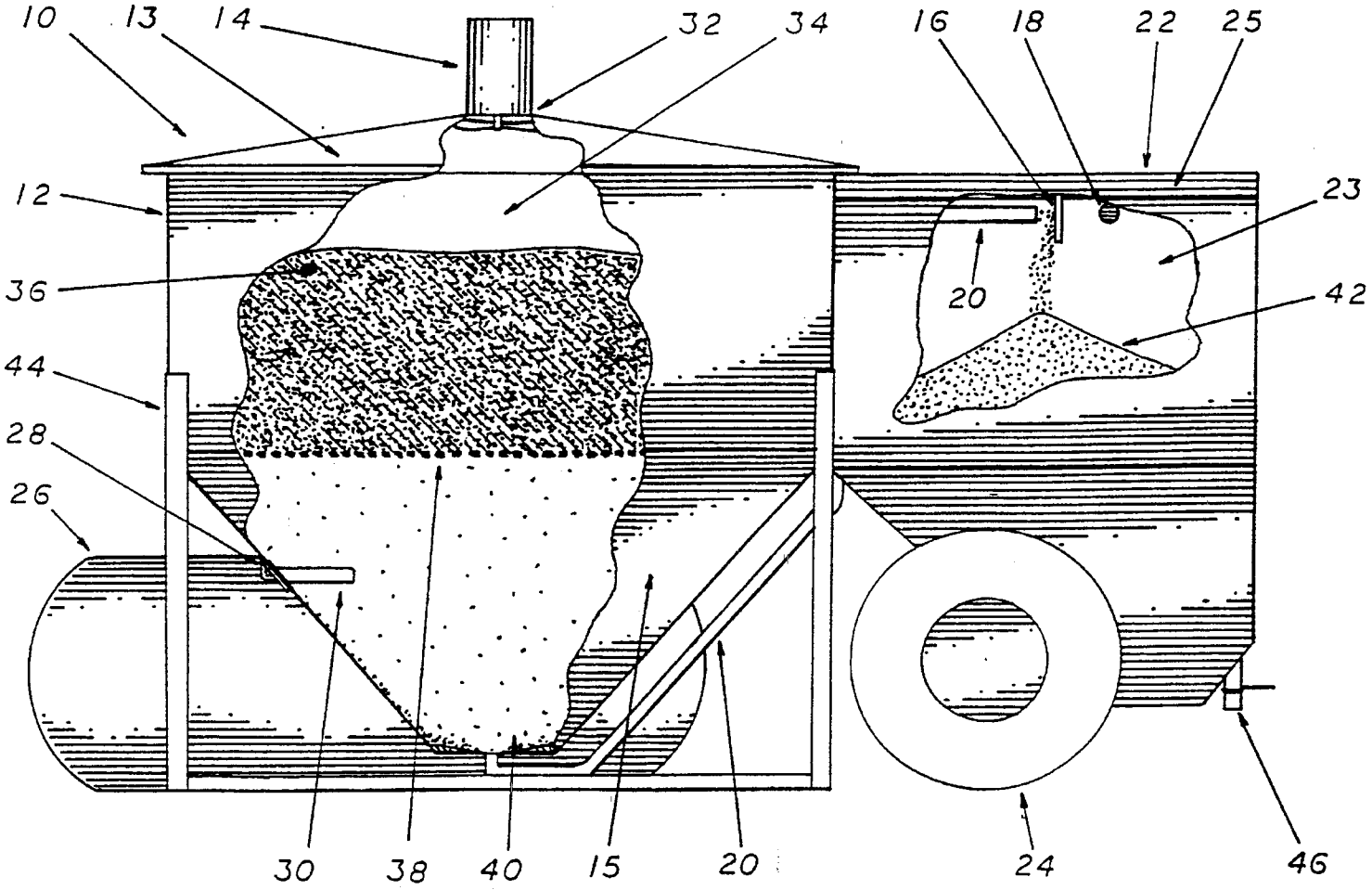
FIG. 4 is a side elevation cut-away view of the present invention showing how the wet sand is dried in the wet sand tank and then transported by the external vacuum for storage in the dry sand tank.

In FIGS. 2, 3, and 4, the manner in which the sand is dried and moved from the wet sand tank 12 to the dry sand tank 22 is more clearly depicted. The wet sand 36 is placed into the wet sand chamber 34 of the wet sand tank 12. In the ceiling 13 of the wet sand chamber 34 is the fan 32 located at the base of the external fan cone 14. The purpose of this fan is to create vacuum in the wet sand chamber which aids in the drying process.

Once sand is placed into the wet sand chamber 34, the wet sand rests on top of a heavy grate 38 which is attached inside of the wet sand tank 12 at the point at which the lower beveled collection area 15 begins. The wet sand 36 does not fall through the grate 38 because of its tendency to clump together due to its cohesive nature.

A heat source 30, such as a propane heater is attached within the open chamber formed under the grate 38, or the lower beveled collection area 15. The heat source 30 is typically fueled by propane which may be stored in an auxiliary propane tank 26. This tank 26 can be located at almost any point outside of the Sand Dryer 10 and supplies the fuel to the heater 30 by means of the heater fuel line 28. When the heater 30 is ignited, the wet sand 36 in the closest proximity to the grate 38 dries, thus, losing its cohesive nature and falling through the grate 38 into the lower beveled collection area 15.

The dry sand 42 then ends up in the funnel area 40 located at the lowest most end of the wet sand tank 12. At the center of the funnel area 40 is a hole to which the dry sand transfer tube 20 is connected. The dry sand transfer tube 20 then runs up the outside wall of the wet sand tank 12 and into the top of the dry sand tank 22.

The transfer of the dry sand 42 is facilitated by the use of an external vacuum source 48 which is connected to the vacuum line hole 18 located in the upper outside wall of dry sand tank 22 by means of the vacuum hose 50. When the dry sand tank optional lid 25 is secured to the dry sand tank 22 it forms an air tight vacuum chamber 23 within the dry sand tank 22. In a further embodiment the dry sand storage tank 22 may consist of a single sealed unit thus, not require the optional lid 25. Thus, when the external vacuum source 48 is applied, a partial vacuum is created in the vacuum chamber which forces the dry sand 42 that has collected in the funnel area 40 of the wet sand tank 12 to move through the dry sand transfer tube 20 into the dry sand tank 22. Upon reaching the end of the dry sand transfer tube 20, the dry sand 42 hits the deflection plate 16, located directly in front of the opening of the transfer tube 20 in the dry sand tank 22, and falls straight down to collect at the bottom of the dry sand tank 22. The dry sand 42 may then be stored within the dry sand tank 22 until needed and removed through the dry sand removal valve 46 located at the lowest most extremity of the dry sand tank 22.

FIGS. 2, 3, and 4 further show how the Sand Dryer 10 is supported by frame 44. This frame 44 stabilizes and holds the Sand Dryer 10 when in use. The Sand Dryer 10 is further equipped with transport wheels 24 which may be utilized to easily move the entire Dryer 10.

Although the present invention has been described in considerable detail with reference to certain preferred versions therein, other versions are possible. For example the shape of the chambers could easily be varied as could the size of the grate used. Further it is to be understood that this Dryer will work equally well on other granular material having the same characteristics as sand. Therefore, the spirit and scope of the appended claims should not be limited to the description of the preferred versions contained herein.

What is claimed is:

1. A drying apparatus for drying granular material comprising:

a wet sand storage and drying tank having an upper wet sand storage chamber and a lower drying chamber;

a grate substantially dividing said upper and said lower chamber with said grate being capable of supporting a substantial load;

a vacuum creating means in said upper wet sand storage chamber;

a heat producing means in said lower drying chamber;

a dry sand storage tank adjacent to said drying tank said dry sand storage tank having an upper and a lower portion;

a means of moving sand from said lower drying chamber of said drying tank to said dry sand storage tank;

a connection between said drying tank and said dry sand storage tank; and a means of removing dry sand from said dry sand storage tank.

2. A drying apparatus as in claim 1 wherein said heat source is a propane burner mounted in said lower drying chamber, said propane burner being connected to a propane source.

3. A drying apparatus as in claim 2 wherein said vacuum means is fan mounted on the upper portion of said wet sand storage chamber.

4. A drying apparatus as in claim 3 wherein said dry sand storage tank is further comprised of a vacuum producing source and said vacuum producing source provides said means of moving sand from said drying tank to said dry sand storage tank via said connection.

5. A drying apparatus as in claim 4 wherein said dry sand removal means is a valve at the lower portion of said dry sand storage tank.

6. A sand drying apparatus as in claim 1 wherein said drying apparatus further comprises two or more transport wheels.

7. A Sand Drying Apparatus comprising:

a wet sand storage and drying tank having an upper wet sand storage chamber said chamber having a top and a bottom and a substantially hopper shaped lower drying chamber;

a removable lid at the top of said storage chamber;

a grate substantially dividing said upper and said lower chamber with said grate being capable of supporting a substantial load;

a vacuum creating means in said upper wet sand storage chamber;

a heat producing means in said lower drying chamber;

a dry sand storage tank fixably mounted adjacent to said drying tank with said storage tank having an upper and lower portion with said lower portion being substantially hopper shaped;

a means of moving sand from said lower drying chamber of said drying tank to said dry sand storage tank;

a connection between said drying tank and said dry sand storage tank;

a means of removing dry sand from said dry sand storage tank; and two or more transport wheels mounted to said Sand Drying Apparatus.

8. A drying apparatus as in claim 7 wherein said heat source is propane burner mounted in said lower drying chamber, said propane burner being connected to a propane source.

9. A drying apparatus as in claim 8 wherein said vacuum means is a fan mounted on the upper portion of said wet sand storage chamber.

10. A drying apparatus as in claim 9 wherein said dry sand storage tank is further comprised of a vacuum producing source and said vacuum producing source provides said means of moving sand from said drying tank to said dry sand storage tank via said connection.

11. A drying apparatus as in claim 10 wherein said dry sand removal means is a valve at the lower portion of said dry sand storage tank.

12. A drying apparatus as in claim 11 wherein said dry sand storage tank further comprises a removable lid about the upper portion of said dry sand storage tank.

* * * * *